US005222731A

United States Patent [19]

Hanabusa et al.

[11] Patent Number: 5,222,731

[45] Date of Patent: Jun. 29, 1993

[54] DEVICE FOR CATCHING A BALL

[75] Inventors: Toshimitsu Hanabusa, Tokyo; Kiyoto Goto, Kawasaki, both of Japan

[73] Assignee: Toshimitsu Hanabusa, Tokyo, Japan

[21] Appl. No.: 724,519

[22] Filed: Jun. 28, 1991

Related U.S. Application Data

[60] Division of Ser. No. 525,039, is a continuation of Ser. No. 393,056, Aug. 10, 1989, abandoned, which is a continuation of Ser. No. 187,644, Apr. 28, 1988, abandoned.

[30] Foreign Application Priority Data

Apr. 30, 1988 [JP] Japan ..... 57-104350
Sep. 30, 1988 [JP] Japan ..... 57-243692

[51] Int. Cl.[5] ..... A63B 69/40
[52] U.S. Cl. ..... 273/26 A
[58] Field of Search ..... 273/26 A, 29 A, 181 R, 273/181 F, 181 H, 181 J, 359, 348, 381, 382, 383, 386, 407, 410, 127 R, 354, 355, 389, 358, 362, 368, 367, 369, 370, 371, 395, 394, 396, 406, 182 R, 366

[56] References Cited

U.S. PATENT DOCUMENTS

| | | | |
|---|---|---|---|
| 1,679,765 | 8/1928 | Lujan | 248/121 |
| 2,040,228 | 5/1936 | Whiteley | 273/26 A |
| 2,247,501 | 7/1941 | Jenks et al. | 273/181 R |
| 2,992,002 | 7/1961 | Bingham, Jr. | 273/26 A |
| 3,206,196 | 9/1965 | Jackson | 273/26 A |
| 3,229,975 | 1/1966 | Tompkins | 273/26 A |
| 3,706,451 | 12/1972 | Dixon | 273/26 A |
| 4,199,141 | 4/1980 | Garcia | 273/26 A |
| 4,390,181 | 6/1983 | Parish | 273/26 A |
| 4,456,251 | 6/1984 | Balaz | 273/29 A |
| 4,489,941 | 12/1984 | Shieb | 273/29 A |
| 4,497,485 | 2/1985 | Macosko | 273/26 A |
| 4,508,343 | 4/1985 | Peters | 273/127 R |
| 4,781,376 | 11/1988 | Barnes, Sr. | 273/26 A |
| 4,793,618 | 12/1988 | Tillery | 273/376 |
| 4,949,972 | 8/1990 | Goodwin | 273/26 A |
| 5,046,729 | 9/1991 | Yancy | 273/26 A |
| 5,064,194 | 11/1991 | Bixler | 273/26 A |

*Primary Examiner*—Theatrice Brown
*Attorney, Agent, or Firm*—Wenderoth, Lind & Ponack

[57] ABSTRACT

A device for catching a ball comprises a frame member 6 constructed on the ground or the like, a net member 7 put on the frame member 6, a mat member 1 disposed substantially at the central part of the net member 7, the mat member 1 having a strike zone 2 defined thereon, a detection means 3 for detecting the position of a pitched ball B in the strike zone 2, and a display means 4 for displaying the detected position of the ball B. When the pitched ball B collides with or passes through the strike zone 2, the detection means 4 detects the colliding or passing position and has a judgment passed on the pitched ball B as to whether it is a strike or ball in accordance with a baseball rule, and the judgment is displayed by the display means 4.

Some devices for catching a ball further comprise a base member 5 permitting the total weight of the device to be arbitrarily varied with a ballast W such as water, sand, steel ball or the like, a pitch target 15 shiftable after every pitch, and/or a ball return system 9 for automatically returning the pitched ball B to the pitcher.

12 Claims, 10 Drawing Sheets

DEVICE FOR CATCHING A BALL

This application is a division of now-abandoned application Ser. No. 07/525,039 filed on May 18, 1990, which is a continuation of now-abandoned application Ser. No. 07/393,056 filed Aug. 10, 1989, which is a continuation of now-abandoned application Ser. No. 07/187,644, filed Apr. 28, 1988.

BACKGROUND OF THE INVENTION

1. Field of the Invention

The present invention relates to a device for catching a ball with which one can perform baseball pitching practice alone, and moreover can pass a judgment of strike or ball on the pitched ball.

2. Description of Relevant Art

Conventionally, to perform baseball pitching practice by oneself, there has been no other way than pitching a ball against a wall surface or the like. Though easily accomplished, such exercise includes the difficulty of judging whether the pitched ball is a strike or not, with the result that the pitching practice itself becomes monotonous, resulting in reduced pleasure.

It therefore is desirable to provide a device for catching a ball which permits even one person to readily perform pitching practice as a matter of course and have a strike judgment passed on the pitched ball, so that he or she can maintain a sufficient interest in pitching practice.

The present invention has been achieved with such a consideration in mind.

SUMMARY OF THE INVENTION

An object of the present invention is to provide a device for catching a ball with which one can perform pitching practice with fun, even alone, while unconsciously building pitching control, and which can be used in a safe manner without slippage from the installed position, turnover or the like, and still more allows transportation as well as relacement from the installed position to be made with great ease.

To achieve the above object, a device for catching a ball according to the present invention comprises a frame member constructed on the ground or the like, a net member put on the frame member, a mat member disposed substantially at the central part of the net member, the mat member having a strike zone defined thereon, a detection means for detecting the position of a pitched ball in the strike zone, and a display means for displaying the detected position of the pitched ball.

Accordingly, even one person is permitted to readily perform pitching practice with the device which has the mat member for the pitched ball to hit. Moreover, with the display means which displays the position that the pitched ball has when it collides on or passes through the strike zone, he or she can easily judge whether or not the pitched ball is a strike, thus improving pitching control without knowing it.

In addition to the above, the device according to the present invention is constituted to be arbitrarily variable in total weight with water, sand, steel ball or the like.

According to the invention, therefore, the device can be transported or replaced from the installed position with ease.

Moreover, the device according to the invention has hooks arranged along a peripheral part of the net member, so that the net member can be easily hooked on the frame member.

Further, the device according to the invention has wind holes opened through the mat member to thereby minimize the effect of wind pressure.

Furthermore, the device according to the invention has a target arranged in the strike zone so as to be shiftable after every pitch, thus permitting a focused pitching practice.

The device according to the invention further comprises a detection means for detecting the pitched ball hitting the pitch target, and a shift control means for automatically shifting the hit target in a programmed direction. The pitcher therefore does not need a remote control, in addition to other preferable advantages such that he or she can have a raised interest in close approximation to the realities of baseball game.

Furthermore, the device according to the present invention comprises a means for returning the pitched ball to the pitcher.

The above and further objects, features and advantages of the present invention will more fully appear from the following detailed description of the preferred embodiment of the invention when the same is read in conjunction with the accompanying drawings.

DETAILED DESCRIPTION OF THE PREFERRED EMBODIMENT

Figure 1:
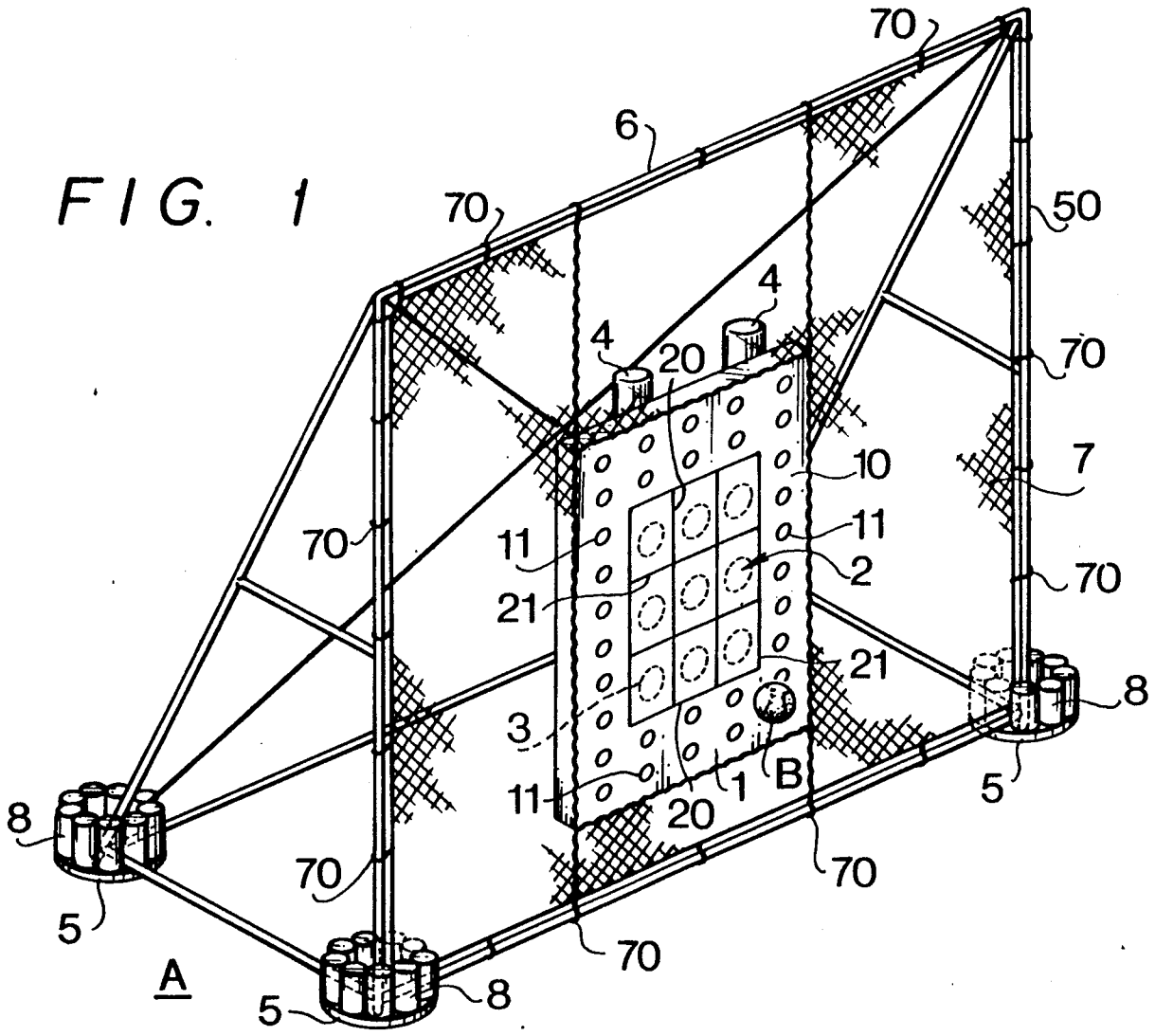
FIG. 1 is a perspective view of a device for catching a ball according to a first embodiment of the present invention.

FIG. 1 shows a device for catching a ball according to a first embodiment of the present invention. The device comprises a mat member 1 having a strike zone portion 2, a detection means 3, and a display means 4.

The mat member 1 is held substantially at the central part of a cover or net 7 put on a frame 6, so that a pitched ball B can be caught with the net 7, when it goes wide of member 1.

Figure 2:
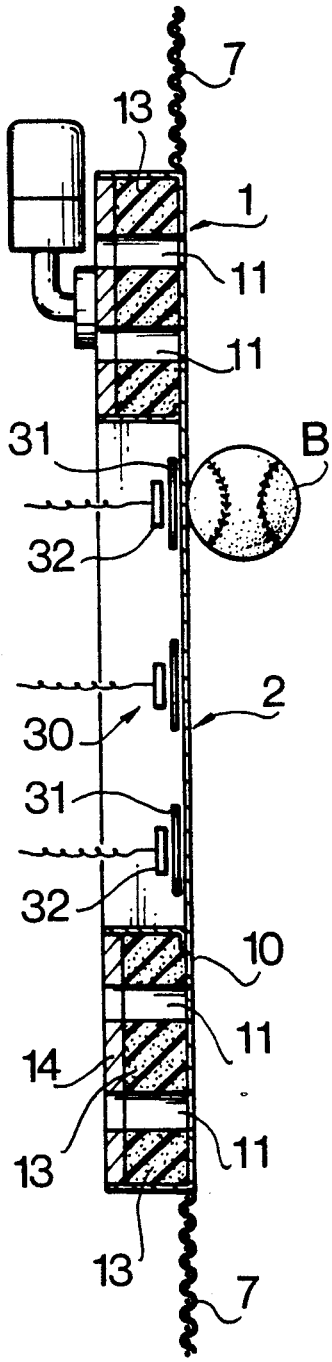
FIG. 2 is a longitudinal sectional view of a mat member with a detection means comprising a pressure switch.

Mat member 1 is made of flexible materials with an adequate area, and has, as shown in FIG. 2, a cushion member 13 interposed between a front plate 10 and a rear plate 14 thereof, to thereby absorb the energy of ball B, softening the impact sound.

The cushion member 13 may exemplarily be formed with floss, kapok, porus soft plastic, straw or the like, or may have a known air bag structure.

Through the body of mat member 1 there are opened a plurality of wind holes 11 at necessary intervals, to thereby minimize the influence of wind pressure on the front plate 10 of mat member 1.

The strike zone portion 2 is formed over an adequate central area of the front plate 10 to define thereon a strike zone conforming to baseball rules.

The portion 2 is divided into nine blocks with a plurality of vertical and horizontal strings 20, 21 (each four in the shown embodiment) made of an elastic linear material. Portion 2 may well be of such a structure that the ball B can pass through.

The detection means 3 is for detecting a hitting position or passing position of the ball B as pitched to the strike zone portion 2, and comprises a pressure switch 30 in the case of detection using energy of collision of ball B, as in FIG. 2.

The pressure switch 30 consists of a microskin 31 put behind the front plate 10 of mat member 1, and an operating bar 32 as a signal generating member located behind the microskin 31. When brought into collision with the front plate 10 on the strike zone portion 2, the ball B exerts impact pressure on the microskin 31, which is thus pushed against the bar 32, turning on a switch of a later-described display means, which displays the position of pitched ball B.

Figure 3:
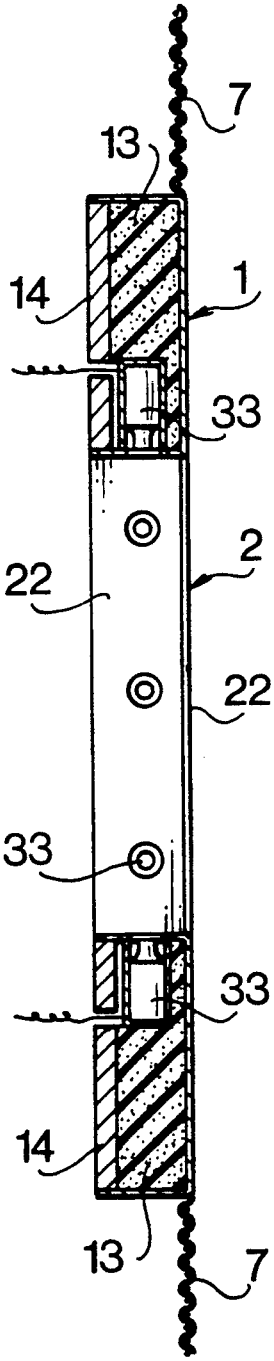
FIG. 3 is a longitudinal sectional view of a mat member with a detection means comprising an optical sensor.

In the case where the strike zone portion 2 is adapted to have the ball B pass therethrough, as shown in FIG. 3, the detection means 3 may preferably consist of a plurality of photo-sensitive switches 33 arranged at predetermined intervals along the circumference of an opening 22 formed through the mat member 1, so that the passing position of ball B can be detected as on-off actions of corresponding switch 33.

The display means 4 is for displaying the results of detection by the detection means 3, and may exemplarily comprise a pair of indication lamps representing strike and ball, respectively or in combination, in a distinguishable manner. Such lamps may preferably be painted red and white, or yellow and green, to permit an easier recognition as to whether or not a strike is scored.

Figure 4:
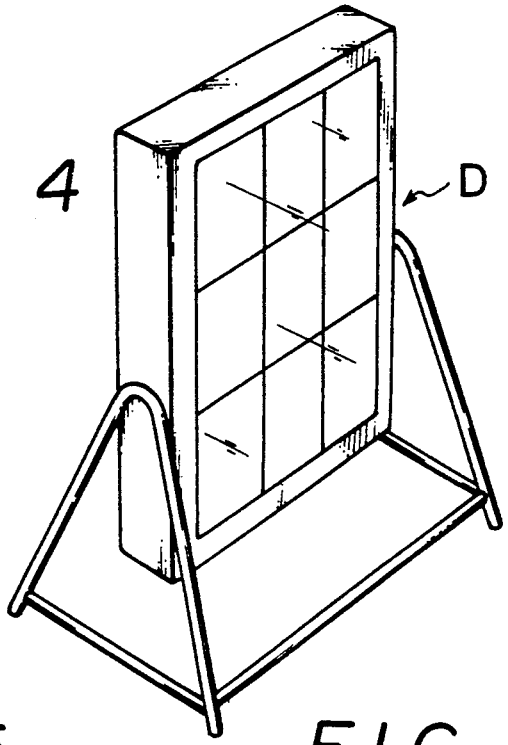
FIG. 4 is a perspective view of an exemplary display means.

Incidentally, as a modification, the display means 4 may comprise a separate indication panel, which may employ a miniature electric bulb, liquid crystal element or the like to constitute a graphic or character display such as of a strike or ball. As in FIG. 4, the indication panel may be a block indicator D of a similar configuration or size as the strike zone portion 2, and may have, upon detection of ball B by detection means 3, a corresponding block lighted with an associated miniature bulb, so that such various ball positions as so-called inside, outside, high and low can be indicated and discriminated thereamong with miniature bulbs in corresponding blocks. The display means may well comprise a synthesized sound producing means so that the ambience can be greatly enhanced with produced sounds such as "strike" or "ball".

The frame 6 of the device is erected on base members 5 installed on a floor or ground surface A.

Each base member 5 to be joined with any lower end of frame 6 is formed like a flat plate and has a weight controller 8 mounted thereon.

Figure 5:
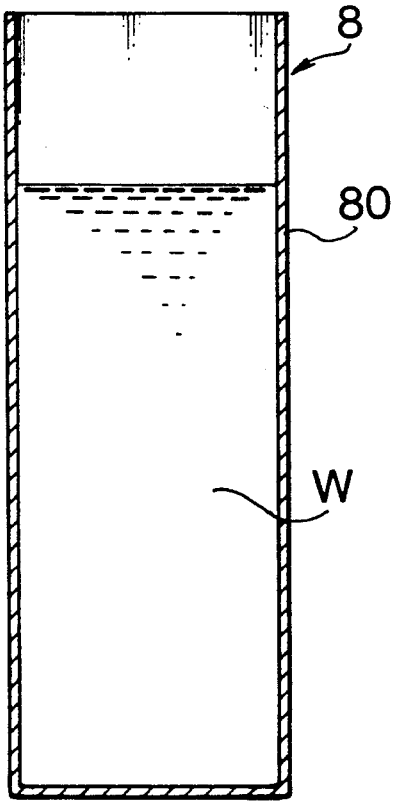
FIG. 5 is a longitudinal section of a weight controller.

The weight controller 8 consists of a plurality of bottomed cylindrical members 80 with necessary ballast W put therein, as shown in FIG. 5. The ballast W may be a volume of water or sand, steel balls or the like.

Those ballasted members 80 of weight controller 8 on each base member 5 successfully prevent the device against slippage from the installed position as well as from turning over with external forces such as by winds. The total weight of the device can be reduced by taking out the contents of weight controllers 8. As a result, the device can be readily transported and replaced from the installed position.

The frame 6 is made of a light-weight material such as an aluminium alloy or a synthetic resin such as a fiber-reinforced plastic to achieve a possibly light-weight structure, and formed of pipe-like members to secure the rigidity and strength.

The net 7 may be stretched in advance on the square circumference of frame 6, whereas more preferably it may have a plurality of substantially J-formed hooks 70 secured to the peripheral part thereof, at predetermined intervals, to be readily hooked on the frame 6.

Such provision of hooks 70 can eliminate a troublesome string-binding work which otherwise might be needed to fasten many peripheral points of net 7 to a pipe member of frame 6 in the course of production or assembly work on the ground or floor, and moreover greatly facilitate the attachment and removal of net 7 to and from frame 6, while permitting simplified replacement.

Figure 6:
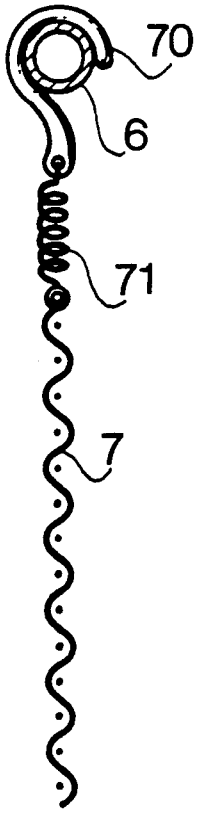
FIG. 6 is a an view showing the constitution of a net engaging hook.

FIG. 6 shows a modification of net 7, in which a coiled spring 71 is interposed between each hook 70 and the peripheral part of net 7. Net 7 can thus be kept tensioned while stretched on the frame 6.

Figure 7:
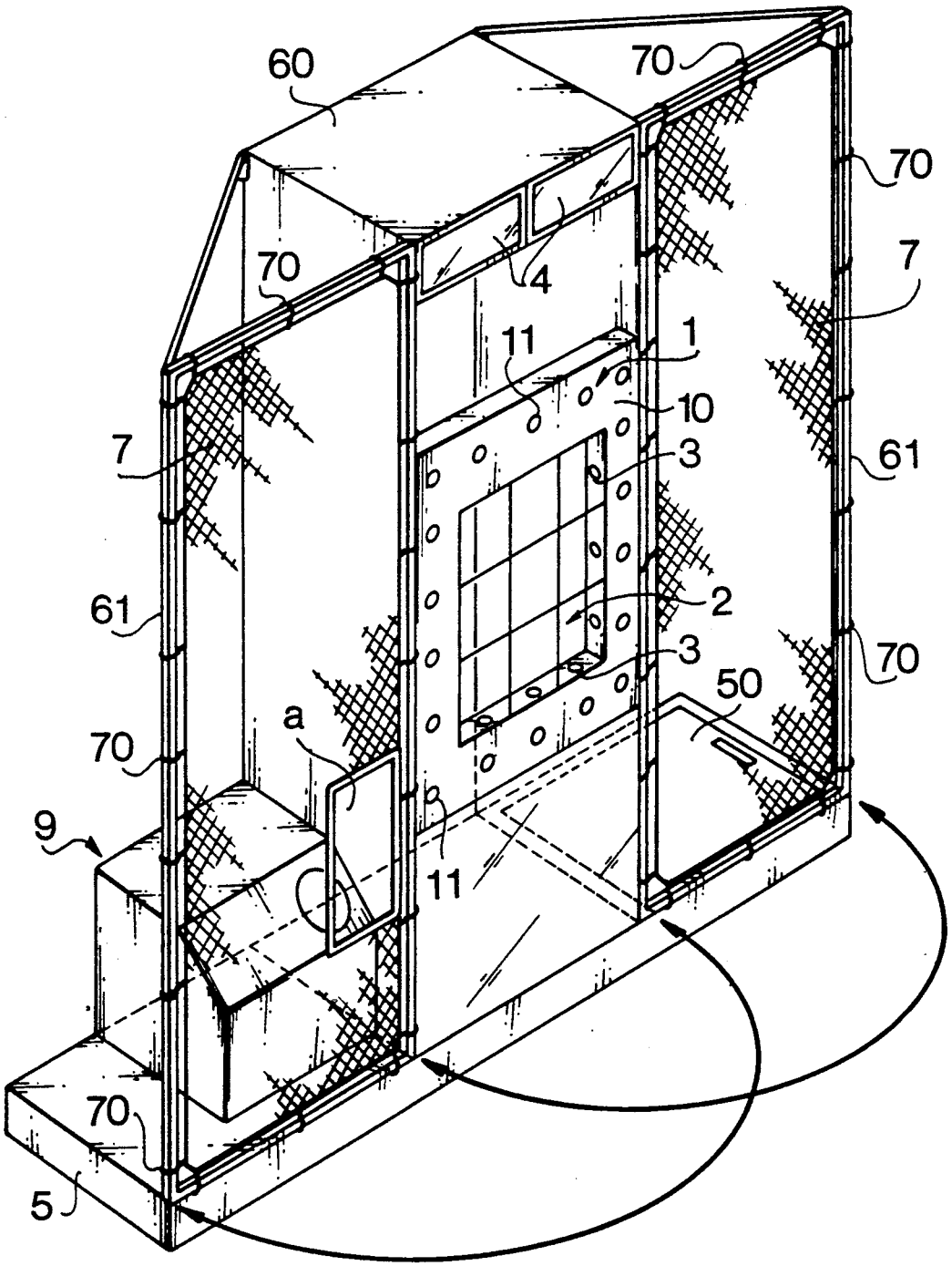
FIG. 7 is a perspective view of the device according to a second embodiment of the present invention.

In FIG. 7 there is shown a device for catching a ball according to a second embodiment of the present invention, which includes a box-like supporting part 60 erected on a longitudinally central part of a later-described base member 5, mat member 1 disposed in a front opening of the supporting part 60, a pair of swingable net frames 61, 61 hinged on both sides of the supporting part 60, and a ball return system. Other features of this embodiment and their effects are similar to those in the first embodiment; like parts are designated by like reference numerals without detailed description.

The base member 5 in this embodiment is hollowed to accommodate therein an adequate quantity of ballast W such as water, sand or iron ball. Base member 5 may have on the upper surface thereof an opening formed therein and covered with a lid 50 to be opened when necessary to ballast or de-ballast the member 5.

This member 5 may also preferably be made of an aluminium alloy, fiber-reinforced plastic or the like.

Moreover, the supporting part 60 and the swingable net frames 61 at both sides thereof may preferably be made of an aluminium alloy or fiber-reinforced plastic, as well.

The supporting part 60 may also be constructed as a netted framing like the frames 61, to thereby achieve a further light-weight construction.

Figure 8:
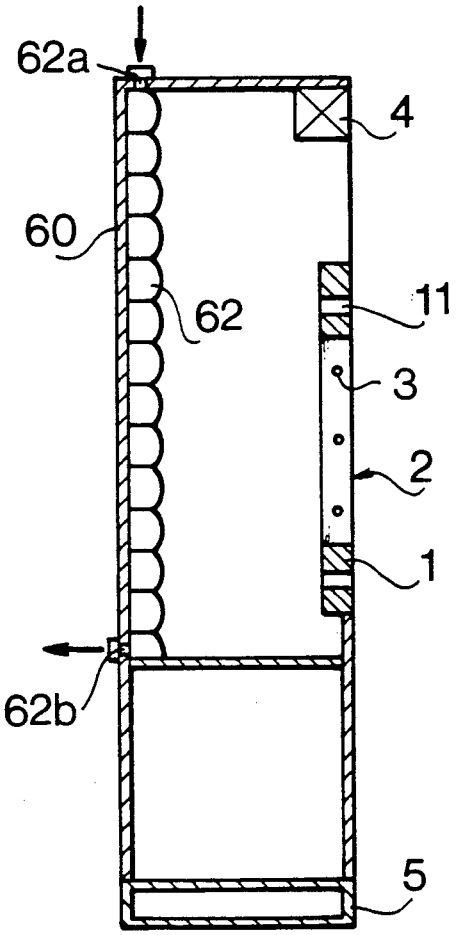
FIG. 8 is a longitudinal sectional view of a supporting part of same device.

FIG. 8 shows a water bag-like cushion member 62 fixed inside of the back wall of supporting part 60.

The cushion member 62 is filled with water supplied from a water inlet 62*a* formed through the top wall of supporting part 60, while water can be discharged by opening a cock 62*b*.

Cushion members 62, as depicted by FIGS. 7 and 8, thus allows the total weight of the catching device to be readily controlled permitting increased stability to be achieved with ease, as well as transportation and like work to be greatly simplified.

Figure 10:
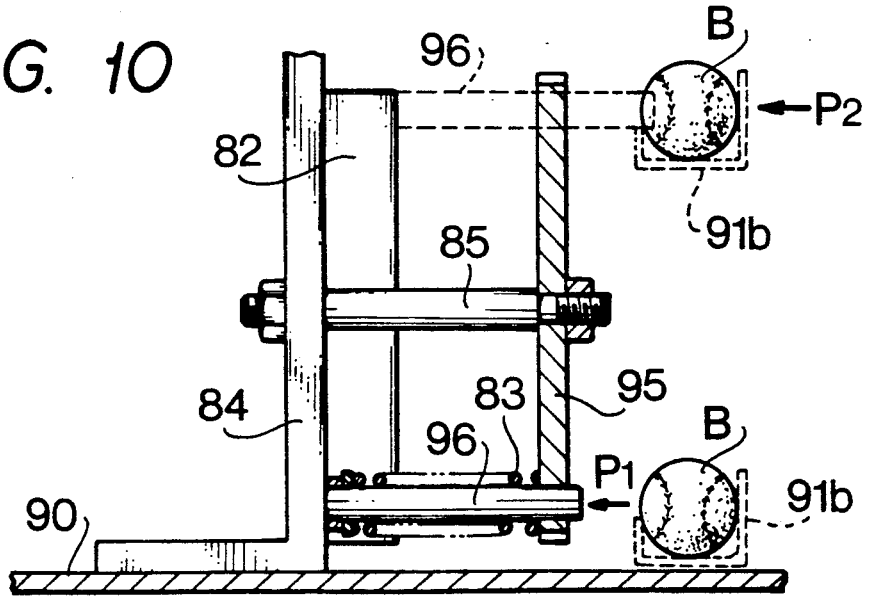
FIG. 10 is a longitudinal sectional view of a pin actuation mechanism of the ball return system.
Figure 9:
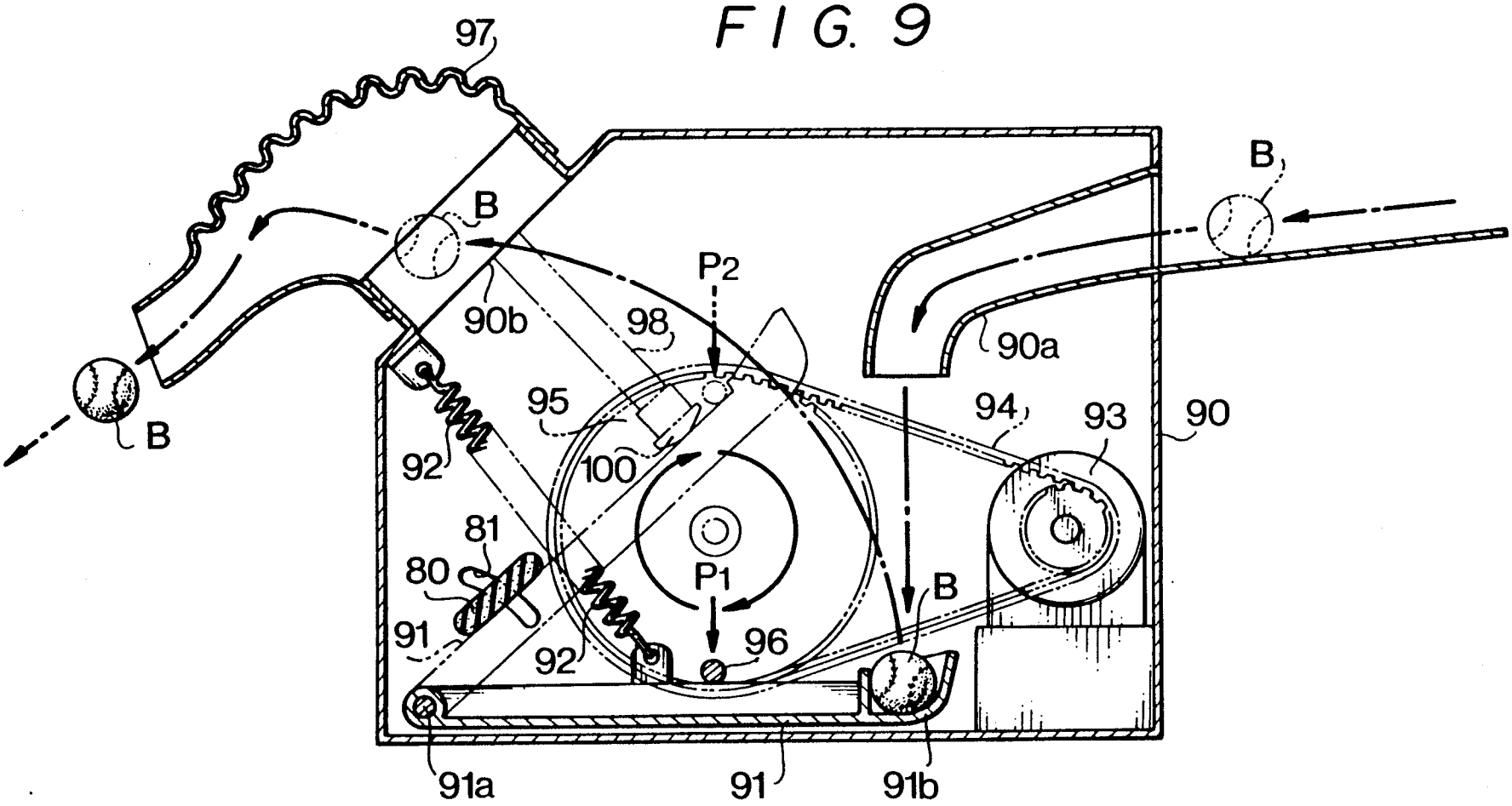
FIG. 9 is a longitudinal sectional view showing a ball return system.

The ball return system 9 is installed as a packaged device at either side of the supporting part 60. As shown in FIGS. 9 and 10, it comprises a housing 90, a ball guide 90*a* by which the ball B, as it has fallen on a bottom area of supporting part 60 after having passed through the mat member 1, is to be guided from the bottom area to a predetermined position in the housing 90, and an action arm 91 for returning the ball B toward the pitcher, from within the housing 90, through an opening 90*b* thereof.

The action arm 91 is vertically swingably pivoted at the base end thereof on a pivot shaft 91*a*, and upwardly biased at the longitudinally central part thereof with a spring 92 to permit a quick counterclockwise action, as in FIG. 9.

The arm 91 swings up and down in accordance with the action of a mechanism comprising a drive motor 93 with a reduction gear, a sprocket 95 driven with a chain 94 stretched from the motor 93, and a transversely movable pin 96 provided at one side of the sprocket 95.

The up and down swing action of arm 91 is limited within an adjustable control range defined with a stopper 80, which is slidable along an arcuate guide slot 81 formed through the side wall of housing 90 and normally fixed in position with an unshown engagement member.

The pin 96 is actuated with a suitable means so as to come out to project at point P2 and get back at point P1, while the sprocket 95 is driven to rotate.

In this embodiment, such actuation is effected, as shown in FIG. 10, with a mechanism comprising a cam member 82 for rightwardly pushing the pin 96, and a spring 83 for leftwardly biasing same. The cam member 82 is fixed to a support member 84, which has a pivot shaft 85 projecting therefrom to rotatably bear the sprocket 95.

The cam member 82 is configured with concave and convex portions such that, as the sprocket 95 rotates, the pin 96 is pushed forth against the resiliency of the spring 83, to engage with action arm 91 at position P2, and pulled back by spring 83, disengaging from the arm 91 at position P1.

As the pin 96 moves with the sprocket 95, the action arm 91 engaged therewith is forced down into a horizontal position, as shown by solid line in FIG. 9, where the ball B is dropped from ball guide 90*a* into a ball reception part 91*b* of arm 91, before the pin 96 retreats, leaving the arm 91 free. The arm 91 disengaged from pin 96 is then urged to quickly swing up by the resiliency of spring 92, so that the ball B is released through opening 90*b*.

In FIG. 9, designated at reference numeral 98 is a hydraulic or spring type damper for cushioning the impulsive force and sound by collision of the action arm 91, when returning the ball B; and 100 is a shock absorbing material put on the head of the damper 98.

The ball return system 9 thus returns the ball B to a person performing the pitching practice, if it is pitched through the strike zone portion 2. The person in practice therefore is not needed to come to the installation positon of the device to collect the ball B after every pitch.

Incidentally, as shown in FIG. 9, the housing 90 of ball return system 9 is provided with a hood 97 at the opening 90*b*, which is for causing the ball B to bound on the ground, as it is forcibly released by the action arm 91. The pitcher is thus allowed to do nothing but simply wait for a returning grounder to take at the feet. It also is possible to select a fly by removing the hood 97.

Figure 11:
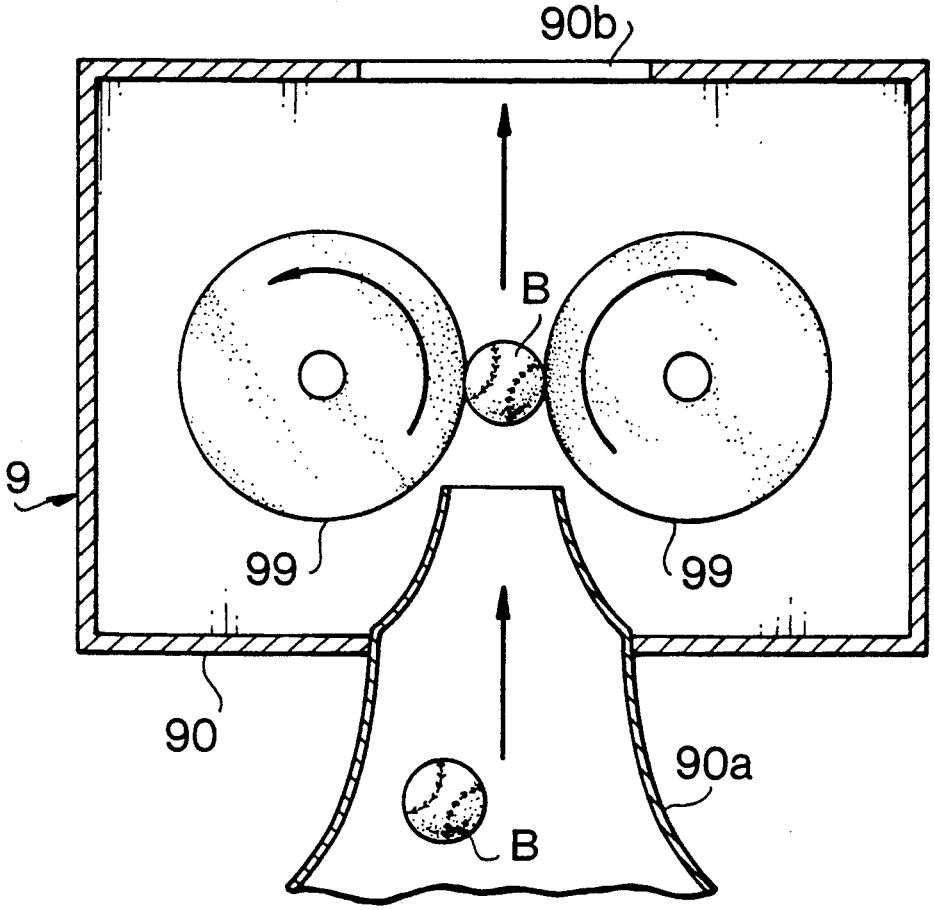
FIG. 11 is a an plan view of a ball return system according to a modification.

FIG. 11 shows a modification of ball return system 9, which employs a known mechanism of so-called pitching machine having a pair of wheels 99, 99 for forcibly sending out a ball B.

The ball return system 9 with wheels 99, 99 permits a fast return to the pitcher, even when balls are continuously pitched in the strike zone portion 2.

In FIGS. 12 to 16 there is shown a device for catching a ball according to the third embodiment of the present invention which employs a shiftable pitch target 15 as a mark for the pitcher to have to hit.

Figure 12:
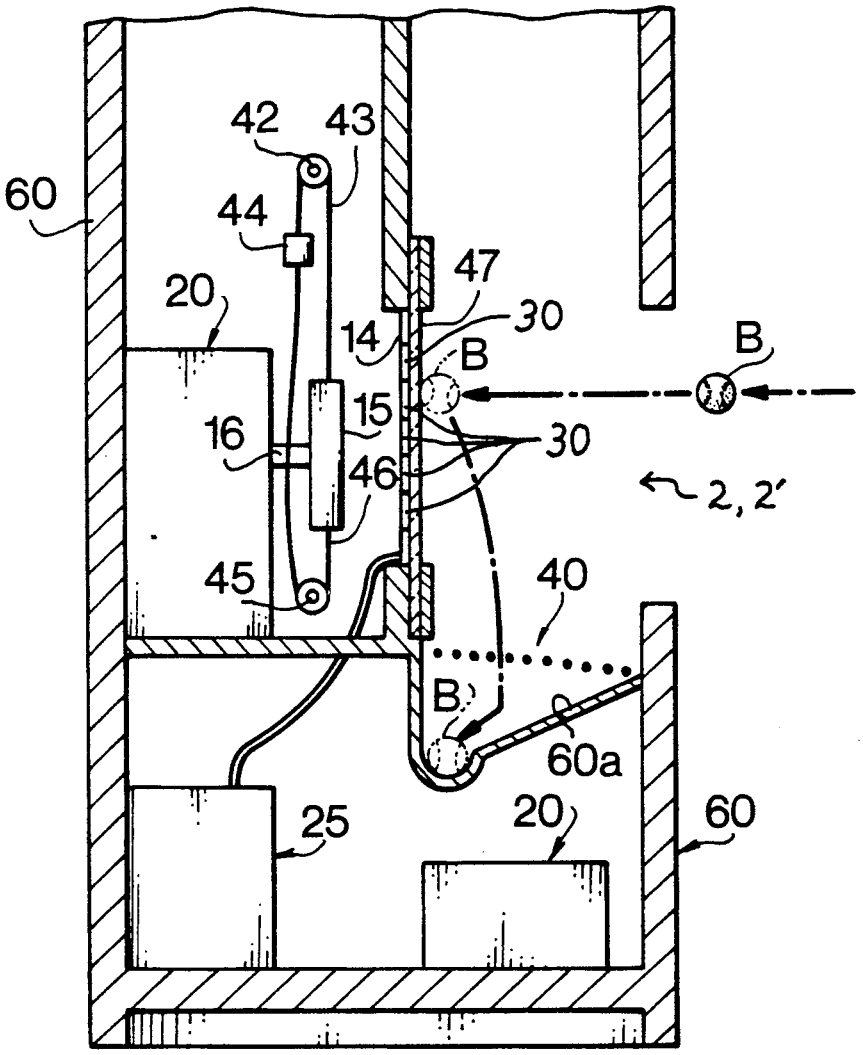
FIG. 12 is a longitudinal sectional view of a supporting part of a device according to a third embodiment of the present invention.

The catching device in this embodiment is fundamentally similar to those in the foregoing embodiments, whereas it includes such additional features that: as shown in FIG. 12, a control unit 20 is disposed in a lower inner space of the supporting part 60; a rope 40 is stretched zig-zag over an inclined bottom plate 60*a* to prevent high rebounds of ball B; and a smooth shifting of the target 15 is successfully achieved with a system in which a carrier of target 15 and a counter weight 44 are looped together with a pair of wire ropes 43, 46 to be stretched over upper and lower pulleys 42, 45. Like parts to the foregoing embodiments are designated by like reference numerals, without particular description.

Control unit 20 will be described below with reference to FIG. 13.

Figure 13:
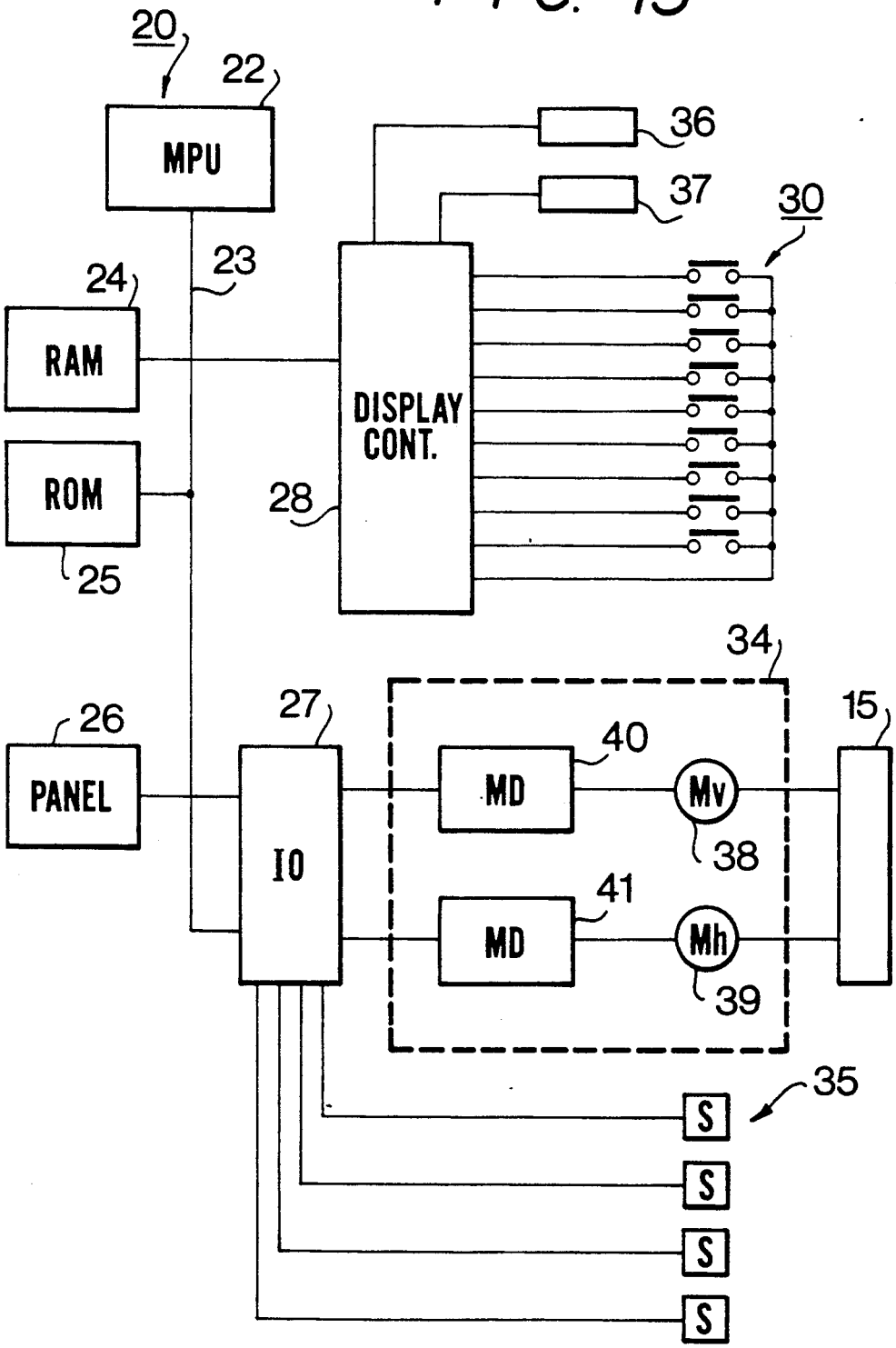
FIG. 13 is a circuit diagram of a shift control system of a pitch target.

In FIG. 13, designated at reference numeral 22 is a micro-processor (hereinafter called MPU), 23 a common bus, 24 a RAM (random access memory), and 25 a ROM (read-only memory) for storing a shift control pattern of target 15 and the like. 26 is a control panel to start and stop the control unit 20. Moreover, 27 is an IO (input-output) port for controlling input signals to the MPU such as from sensors 35 located as required for positional detection of the target 15, and output signals from MPU such as to a drive control unit 34.

The ball detection means in this embodiment comprises a plurality of pressure switches 30, and a display controller 28 which turns on an indication lamp 36 or 37, depending on a judgment to be passed, when any switch 30 is on, as to whether the position is a marked one. The controller 28 may preferably display the marked position for each strike, as well.

If any switch 30 is operated by pitched ball B, the display controller 28 sends out an interrupt signgal through common bus 23 to MPU 22.

Drive control unit 34 comprises a pair of stepping motors 38, 39 for horizontally and vertically shifting the target 15, respectively, while the motors 38, 39 are controlled with motor drive circuits 40, 41 receiving pulse signals through IO port 27. This control unit 34 and the control unit 20 cooperatively constitute a shift control means of the target 15.

There is an unshown framework including a pair of vertical rails arranged parallel to each other, a horizontal rail vertically movably bridged therebetween, and a vertical frame for assisting the vertical movement of the horizontal rail. The pitch target 15 is carried by the horizontal rail. Motor 38 receives a total weight of target 15, motor 39 and the horizontal rail, and has to bear a significant load when it upwardly drives the target 15. To reduce the load, the horizontal rail is bound to the loop of wire ropes 43, 46 with counter weight 44, while pulleys 42, 45 are fixed to the upper and lower ends of either vertical rail, as in FIG. 12.

Pitch target 15 may well be shifted by using a known X-Y shifting mechanism or linkage.

In this embodiment, if it is a strike, the pitched ball B hits a soft transparent member 47 disposed in front of the target 15 and falls on the inclined bottom plate 60*a*, where it may rebound high. Such rebounds however are successfully prevented with rope 40 continuously and alternately stretched zigzag over the bottom plate 60*a*, with slightly smaller intervals than the outside diameter of ball B. Falling ball B thus touches rope strings, before it spreads the interval therebetween, passing therethrough to fall on the plate 60*a*. In this respect, the tension of stretched rope 40 is adjusted so that the ball B can pass through when it falls from above, but cannot when rebounding from the inclined bottom plate 60*a*.

Figure 14:
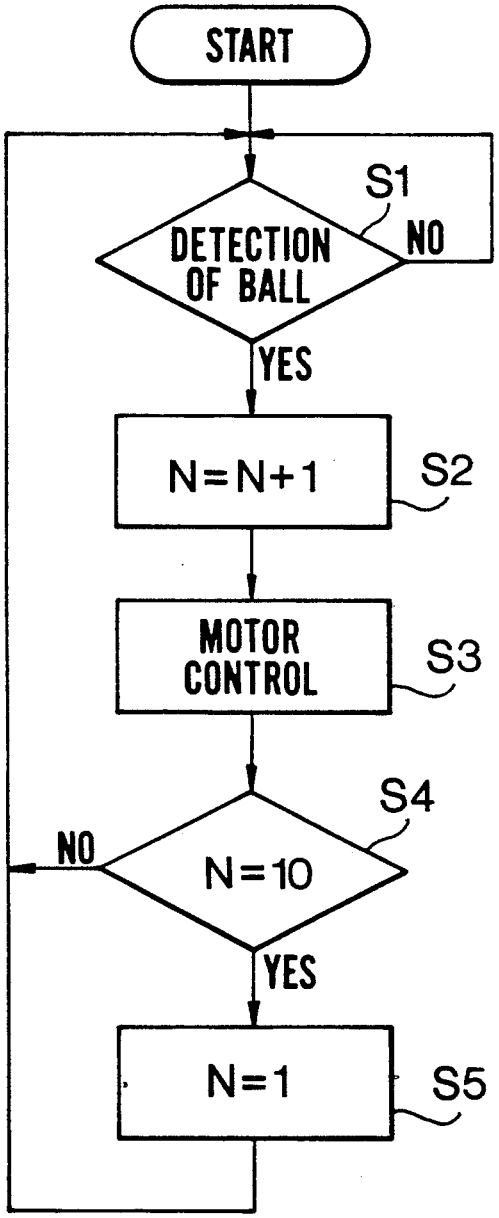
FIG. 14 is a flowchart of same system.

Function of the device in this embodiment will be described below, with reference to FIGS. 12 and 14.

When the device is ready with the main power flipped on, the control unit 20 starts waiting for a pitch.

Pitched ball B from the pitcher first passes through the opening 2', if a strike, and then hits transparent member 47, marked or not, producing an impulsive force, which operates corresponding one of pressure switches 30, turning it on.

The display controller 28 passes judgment as to whether the hit position is a marked one or not by turning on a corresponding indication lamp 36 or 37, while sending an interrupt signal to MPU 22. Concurrently, the control unit 20 recognizes an active state of the interrupt signal to thereby detect the event of collision of ball B, which permits a program flow to go from a step S1 to step S2.

At the step S2, a count N is incremented once before the program flow goes to a step S3.

At the step S3, a control signal is output to shift the center of target 15, depending on the value of count N as incremented.

Then, at a step S4, the count N as incremented is judged as to whether or not the value equals to ten. If it is not ten, flow again goes to step S1. In the case where the value is ten, count N is initialized to one before the flow goes to step S1.

Figure 15:
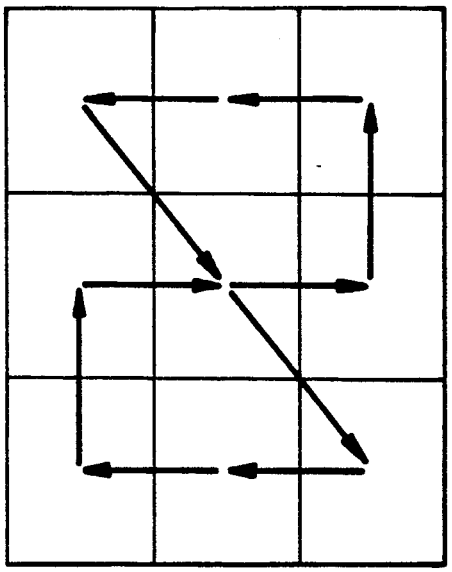
FIG. 15 is a graphic representation of an exemplary shift locus pattern of a pitch target under control of the same system.
Figure 16:
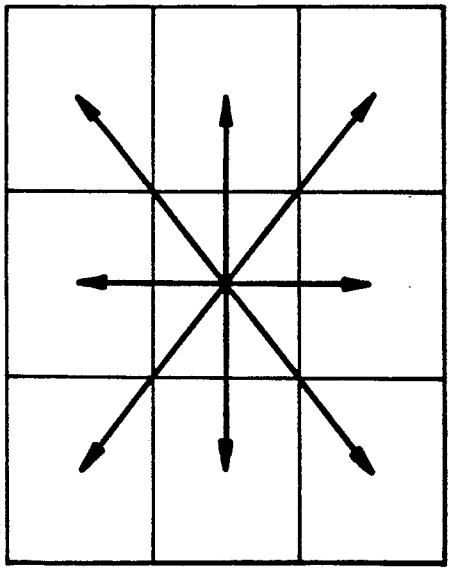
FIG. 16 is a graphic representation of another exemplary shift locus pattern of same target.

FIG. 15 shows loci of the center of target 15 when controlled as described. The locus pattern of FIG. 15 is sequential. It may however be radial as in FIG. 16. In the case of a sequential pattern, the loci may well form an inverted triangular, quadrilateral, pentagon, etc. or combination thereof. The pattern can thus be arbitrarily determined when programmed.

In the embodiment above, pressure switch 30 is disposed between soft transparent member 47 and pitch target 15. Such switch may however be eliminated to abandon judgment, and target 15 set close to transparent member 47, while providing a shaft 16 of target 15 with a damping function, so that upon collision of the ball B the target 15 can be pushed back with the impulsive force, to turn on an actuation switch of drive control unit 20.

Figure 17:
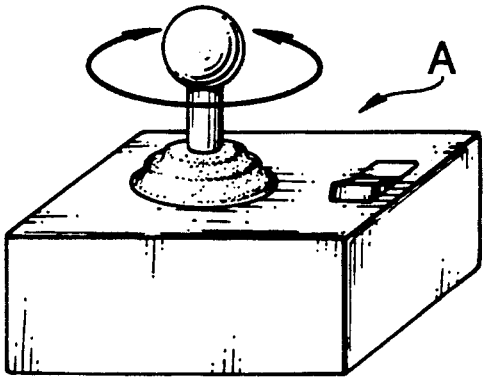
FIG. 17 is a perspective view of a manual remote control system.

Moreover, in the third embodiment, the pitch target 15 is automatically shifted every time ball B hits. The shift of the pitch target may however be arbitrarily effected, for example by using such a manual-remote control unit A as shown in FIG. 17.

Although there has been described what is at present considered to be the preferred embodiment of the invention, it wiil be understood that the present invention may be embodied in other specific forms without departing from the spirit or essential characteristics thereof. The present invention is therefore to be considered in all respects as illustrative but not restrictive. The scope of the invention is indicated by the appended claims rather than by the foregoing description.

We claim:

1. A ball catching device comprising:

a frame defining a strike zone;

a target mounted to said frame in alignment with at least a portion of the strike zone;

detection means for detecting the occurrence of a ball being in the strike zone in alignment with said target;

display means operatively connected to said detection means for indicating the occurrence of a ball being in the strike zone in alignment with said target;

target shifting means, operatively connected to said target, for shifting the location of said target relative to said frame;

control means for controlling the shifting of said target by said target shifting means in a predetermined manner; and wherein said detection means comprises a photosensitive means for detecting when a ball is in the strike zone in alignment with said target.

2. A ball catching device as recited in claim 1, wherein said control means comprises a microprocessor unit.

3. A ball catching device as recited in claim 1, wherein said control means is operable to shift said target means along a predetermined path.

4. A ball catching device as recited in claim 3, wherein said control means is operable to shift said target to a predetermined position after each occurrence of a ball being in the strike zone in alignment with said target as detected by said detecting means.

5. A ball catching device as recited in claim 1, wherein said control means comprises a remote control means for controlling the shifting of said target by said target shifting means from a location remote from said frame.

6. A ball catching device as recited in claim 5, wherein said control means further comprises a microprocessor unit.

7. A ball catching device as recited in claim 1, wherein said photosensitive means comprises a plurality of photosensors mounted in predetermined locations relative to said strike zone.

8. A ball catching device comprising:

a frame defining a strike zone;

a target mounted to said frame in alignment with at least a portion of the strike zone;

detection means for detecting the occurrence of a ball being in the strike zone in alignment with said target;

display means operatively connected to said detection means for indicating the occurrence of a ball being in the strike zone in alignment with said target;

target shifting means, operatively connected to said target, for shifting the location of said target relative to said frame;

control means for controlling the shifting of said target by said target shifting means in a predetermined manner;

a ball return means, mounted to said frame, for returning a ball toward a location forwardly of said frame after the ball has been thrown through the strike zone;

wherein said ball return means comprises an ejection means for ejecting a ball, and a motor means for operating said ejection means; and wherein said ejection means comprises an action arm pivotably mounted to said frame for movement between a cocked position and an ejecting position, biasing means for biasing said action arm toward its ejecting position, and lock means, operatively connected to said motor means, for releasably locking said action arm in said cocked position.

9. A ball catching device as recited in claim 8, wherein said motor means is operable to force said action arm from said ejecting position to said cocked position.

10. A ball catching device as recited in claim 9, wherein said ball return means further includes a housing mounted to said frame;

said motor means includes a motor mounted to said housing and having an output shaft, a first sprocket mounted to said output shaft, a second sprocket rotatably mounted to said housing, and an endless element trained about said first and second sprockets; and said lock means comprises a pin mounted to said second sprocket for movement between an extended position in which it engages said action arm and retains it in said cocked position, and a retracted position in which it is retracted out of engagement with said action arm.

11. A ball catching device as recited in claim 10, wherein said lock means further comprises a spring means for biasing said pin toward its retracted position, and a cam means for forcing said pin into said extended position against said spring means.

12. A ball catching device as recited in claim 8, wherein said detection means comprises a plurality of pressure switch means for detecting the impact of a ball hitting a predetermined location on said target.

* * * * *